US006547384B2

(12) United States Patent
Hayashi

(10) Patent No.: US 6,547,384 B2
(45) **Date of Patent: *Apr. 15, 2003**

(54) PRINTING APPARATUS AND METHOD

(75) Inventor: Shigeru Hayashi, Shiojiri (JP)

(73) Assignee: Master Mind Co., Ltd., Matsumoto (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/500,979

(22) Filed: Feb. 15, 2000

(65) Prior Publication Data

US 2003/0007056 A1 Jan. 9, 2003

(51) Int. Cl.[7] ..... B41J 2/01

(52) U.S. Cl. ..... 347/103; 400/56; 400/58; 400/76

(58) Field of Search ..... 347/103, 101, 347/100, 105, 102, 96, 98; 400/56, 76, 57, 58

(56) References Cited

U.S. PATENT DOCUMENTS 4,676,675 A * 6/1987 Suzuki et al. ..... 400/56
4,725,849 A * 2/1988 Koike et al. ..... 346/1.1
4,756,963 A * 7/1988 Yamamoto et al. ..... 428/334
4,847,638 A * 7/1989 Moriyama ..... 346/140 R
4,943,816 A * 7/1990 Sporer ..... 346/25
5,156,467 A * 10/1992 Kitahara et al. ..... 400/120.17
5,360,345 A * 11/1994 Brauner et al. ..... 446/397
5,795,425 A * 8/1998 Brault et al. ..... 156/235
5,806,992 A * 9/1998 Ju ..... 400/56
5,940,106 A * 8/1999 Walker ..... 347/104
5,984,466 A * 11/1999 Nagashima et al. ..... 347/101
5,984,467 A * 11/1999 Bodager et al. ..... 347/101
6,084,620 A * 7/2000 Morikawa et al. ..... 347/96
6,092,890 A * 7/2000 Wen et al. ..... 347/101
6,102,509 A * 8/2000 Olson ..... 347/8

* cited by examiner

*Primary Examiner*—Andrew H. Hirshfeld
*Assistant Examiner*—Darius N. Cone
(74) *Attorney, Agent, or Firm*—William C. Cray

(57) ABSTRACT

This invention is related to a printer and printing method that prints on recording media with water soluble ink by using an ink jet printer. It is related to the printing method that can create printed images with supreme durability especially on recording media or stiff panels of different thickness with water absorbent surfaces, like wood boards, porous plastic boards, and the like, and on a recording media with water resistant surfaces, like plastic boards, glass or metal plates and the like, to which an emulsion adhesive layer is applied for a printing layer. The printer of the invention has features enabling movement past the print head of media of different thickness and formed as panels while the image surfaces of the panels are vertically properly spaced from the print head for printing.

12 Claims, 6 Drawing Sheets

PRINTING APPARATUS AND METHOD

BACKGROUND OF THE INVENTION

Various objects such as compact disc surface, and the like, besides general recording papers can be used as printing objects of an ink jet printer. The owner of the present application previously proposed a printer that placed recording media like CD, or the like, on a medium transporting tray and transported the medium transporting tray through the printing position of an ink jet head in order to print on the surfaces of the CD by using an ink jet printer.

Since ink jet printers generally use water soluble ink, they cannot use the materials that do not accept water soluble ink as recording media. For example, if the ink jet printer prints on the surfaces of highly water absorbent surface like wood, and the like, ink solution will be absorbed by wood and the printed image cannot be preserved on the wood surface. On the other hand, if the ink jet printer prints on a recording medium with a water resistant surface such as plastic boards, glass or the like, ink solution cannot be absorbed at all because of surface tension. Therefore, the printed image will be printed weakly on the surface of such recording medium and will be peeled off easily.

SUMMARY OF THE INVENTION

An object of this invention is to provide an ink jet printer and a printing method using an ink jet printer that can create highly permanent and durable printed images on highly water absorbent wood and other absorbent panels.

Another object of this invention is to provide a printer and printing method using an ink jet printer that can create highly permanent and durable printed images on highly water resistant recording media like plastic boards, glass panels and other water resistant panels.

In order to solve the above objects, this invention involves a printer and a printing method using an ink jet printer with features of creating an image receiving layer on the printing surface by applying emulsion adhesive on the printing surface of a recording medium and then creating printed images with water soluble ink on the surface of the image receiving layer by using an ink jet head or other equivalent ink type printers.

The image receiving layer created by emulsion adhesive is most adequate for the printing surface for water soluble ink and can obtain extremely permanent printed images. Therefore, it enables the printing on highly water absorbent recording media wood panels, and the like, as well as water resistant media such as plastic panels, and the like.

For printing panels for objects such as outdoor billboards, and the like, it is desirable to create a ultraviolet resistant layer by applying UV blocking agent such as xylene solution, or other agent, on the surface of the said image receiving surface after printed images are created in order to improve weather resistance of printed images.

Also, in order to improve durability of printed images, after the printed images are created, it is desirable to create a protection layer of resin paint on the surfaces of the printed images or on the surface of the ultraviolet resistant layer.

This invention has a feature of creating the said image receiving surface by using emulsion adhesive with water resistant water paint. It also has a feature of creating the said image receiving surface by using emulsion adhesive with surfactant.

Such an image receiving layer has supreme adherence or stability for water resistant surfaces like plastic boards and metal plates, and the like. Therefore, highly permanent printed images can be created on the surface of highly water resistant materials by creating the printed images on this image receiving layer with water soluble ink.

Also, this invention has a feature of creating the said image receiving layer by using emulsion adhesive with coloring components like cosmetics, dyes, and golden or silver powder, and the like. Also, the invention has a feature of creating the said image receiving layer by using emulsion adhesive with fragrance.

An ink jet printer for the printing method of this invention transports a medium of different thickness by transporting means, which include in one form a transporting tray carrying a recording medium through the printing position of a printing head which prints on the surface of the said recording medium. It is desirable to use ink jet printers that have a transporting connection part to transport this medium transporting medium through the said printing position by rubbing against or biting into the said medium or a transporting tray and an interval adjustment mechanism to move the medium relative to the printing head in a direction closer to or further from the said printing head. With such a printer, the printing can be done on panels of wood and plastic or metal panels of different thicknesses, as well as printing on general recording papers.

The invention, including the printer and the method of printing will be hereinafter described in relation to the drawings forming a part of this application.

DESCRIPTION OF THE PREFERRED EMBODIMENT

An example of ink jet printers that are adequate for the printing method described below will be explained.

Figure 1:
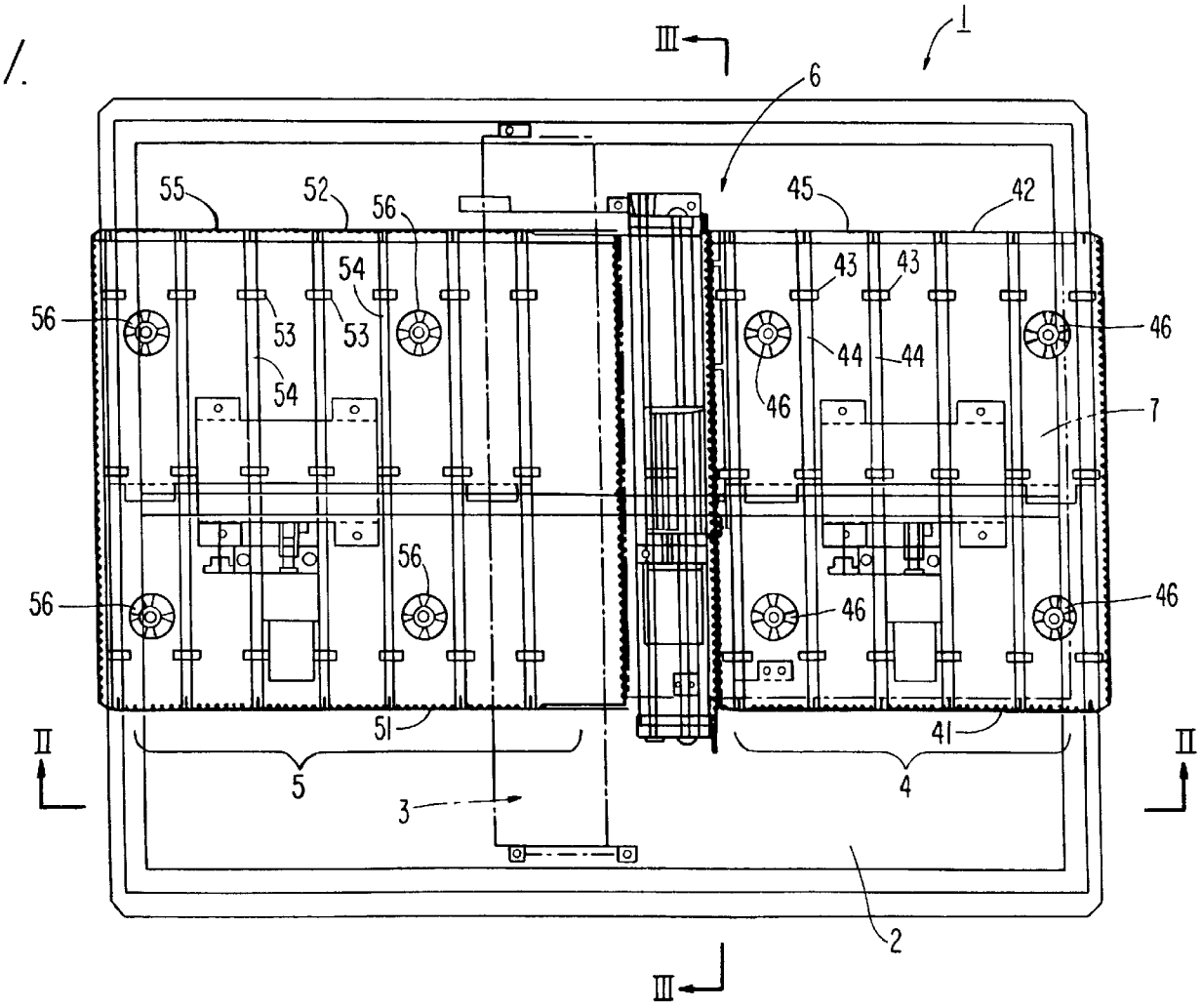
FIG. 1 is a top plan of the ink jet printer of this invention.
Figure 2:
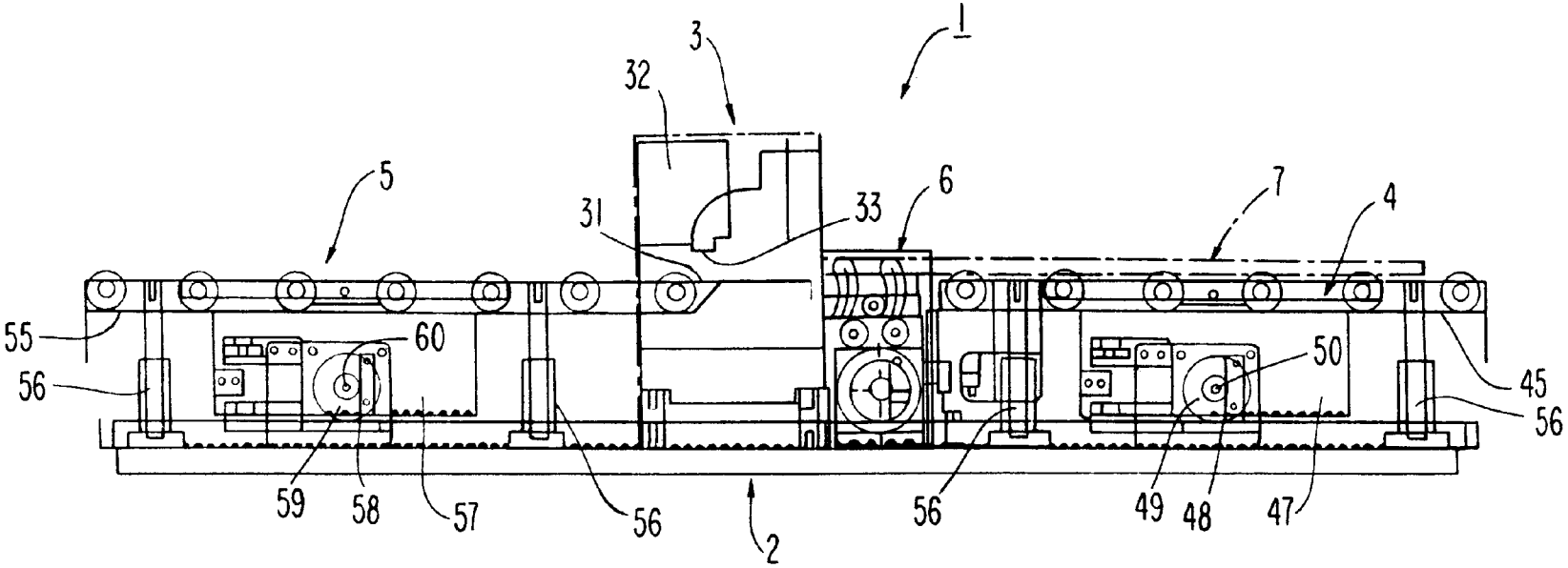
FIG. 2 is a side view on the line II—II of the ink jet printer in FIG. 1.
Figure 3:
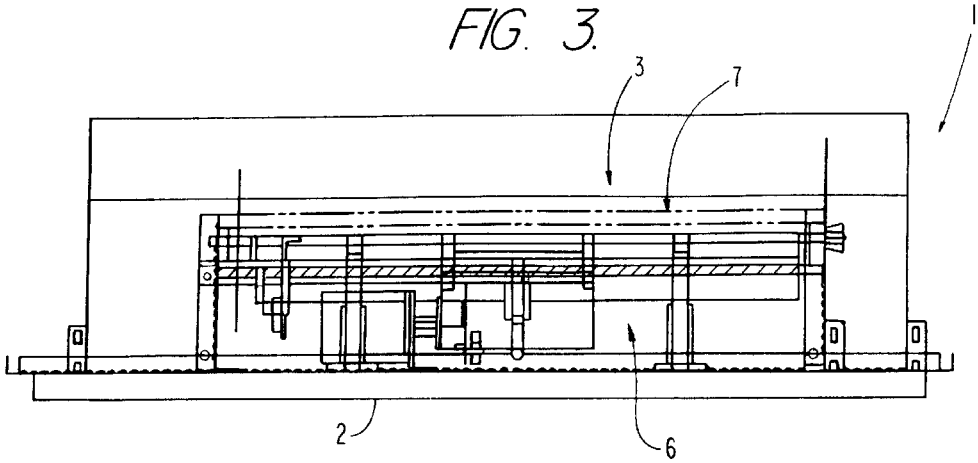
FIG. 3 is a cross section in the line III—III of the ink jet printer in FIG. 1.

As seen in the drawings, referring first to FIGS. 1 through 3, the ink jet printer 1 of this example has a raised frame 2 of suitable height, an ink jet head unit 3 located almost at the center of the top of this frame, a paper feeding side tray guide 4 located on the paper feeding side of this head unit 3, a paper ejecting side tray guide 5 located on the paper ejecting side of the head unit 3, and a tray transporting means or unit 6 located between the head unit 3 and the paper feeding side tray guide 5. Also, it has a medium transporting tray 7 that moves back and forth along the transporting path through the font position 31 of the head unit 3 by this transporting unit 6. If desired or preferred, the transport may be of another type using feed rollers and means for aligning the media while permitting vertical adjustment of the space between the print head and the transported media.

Figure 4:
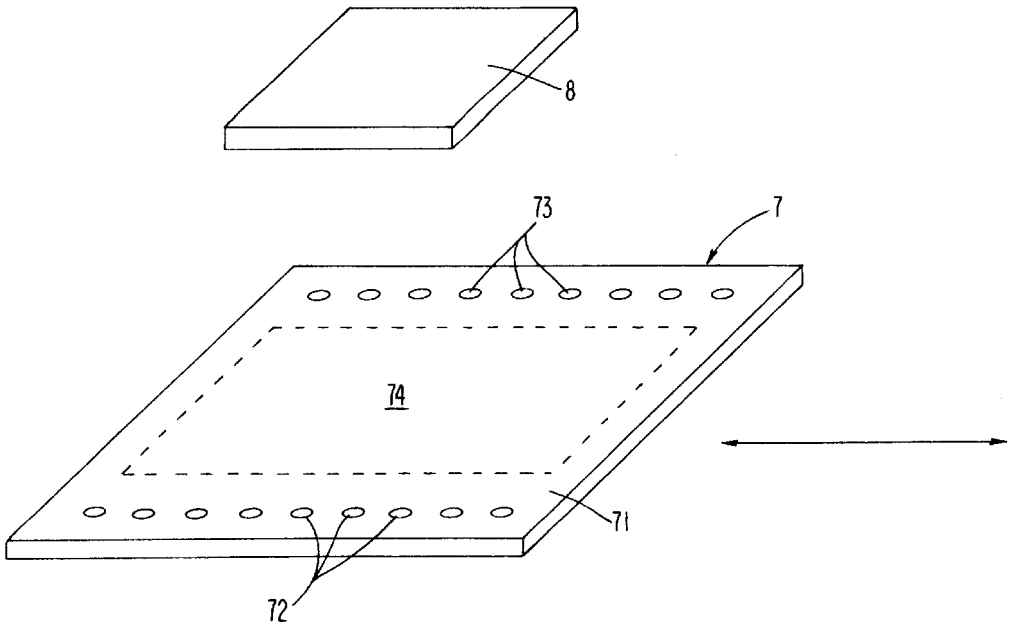
FIG. 4 is a perspective of the medium transporting tray of the ink jet printer in FIG. 1.

FIG. 4 is a perspective that shows a medium transporting tray. As indicated in FIG. 4, the medium transporting tray 7 has a square board 71 with specific thickness and sprocket holes 72 and 73 that are placed in lines toward a transporting direction along both sides of this square board. The area surrounded by a dotted line on the flat surface of the square board 71 is a receiving surface 74 for a recording medium. A recording medium 8 such as a thick wood board or a thick plastic panel, and the like, is placed on this receiving surface 74.

Figure 5:
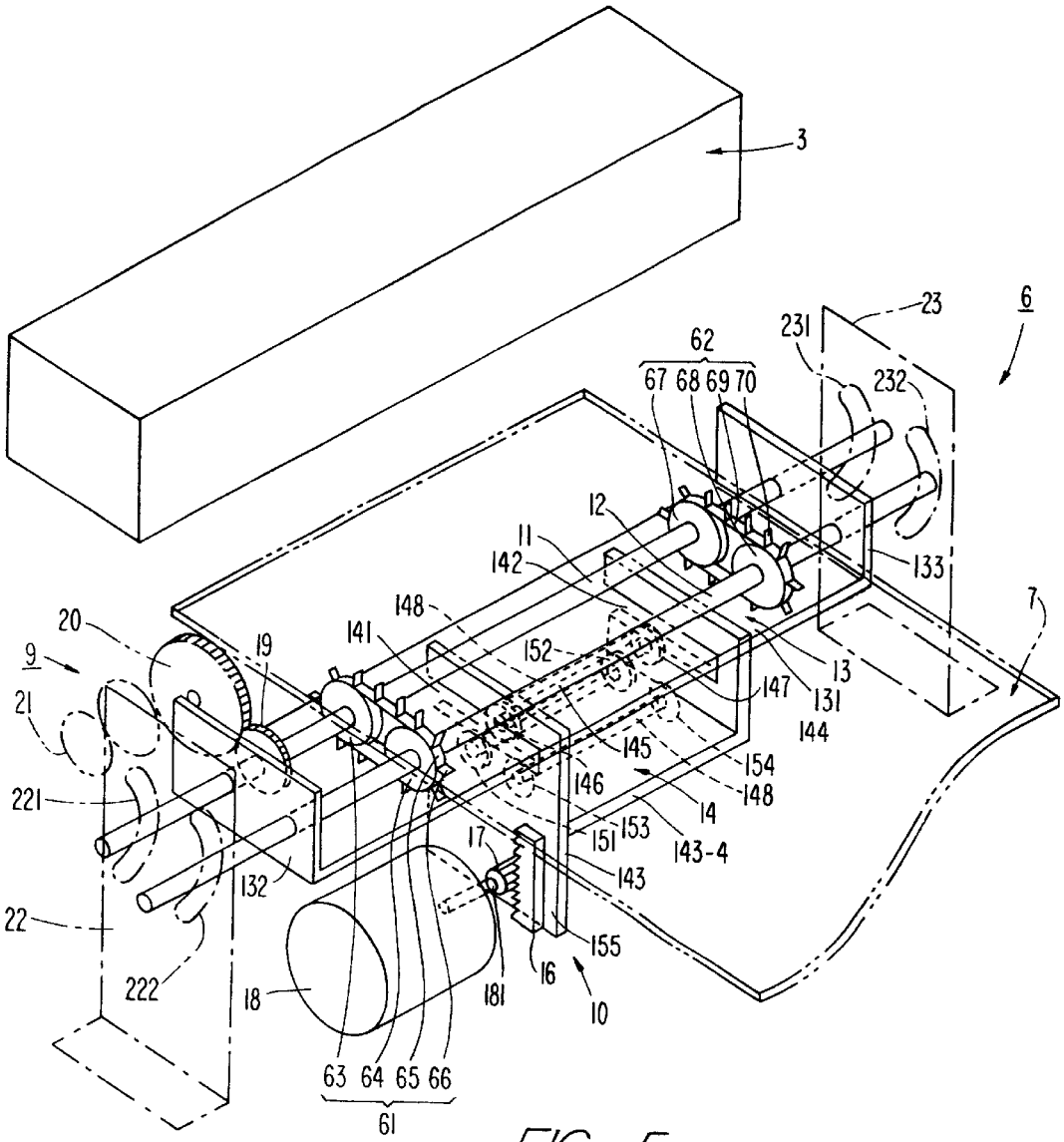
FIG. 5 is a perspective view showing the medium transporting tray of the ink jet printer in FIG. 1.
Figure 6:
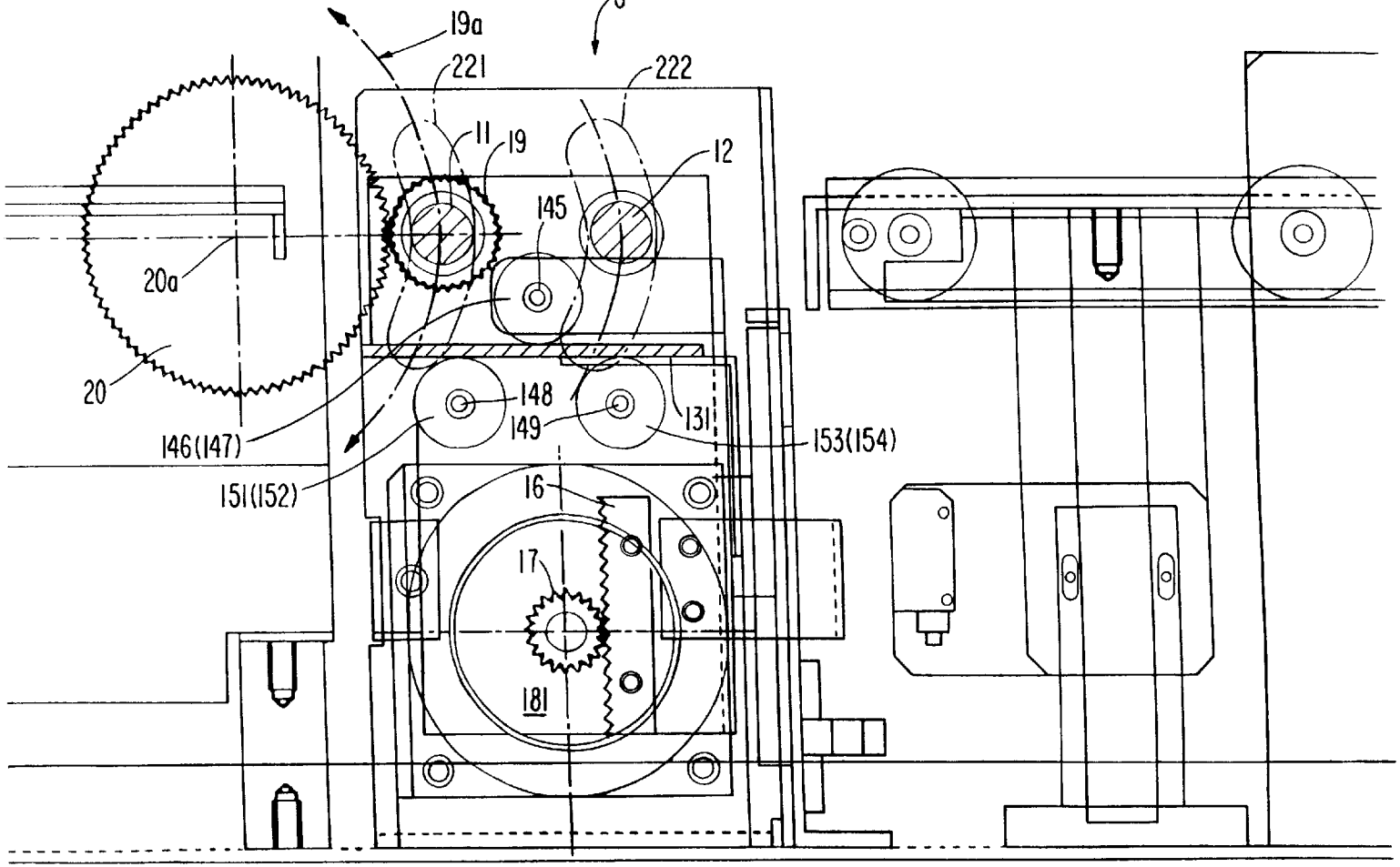
FIG. 6 is a view showing the side construction of the medium transporting tray of the ink jet printer in FIG. 1.
Figure 7A:
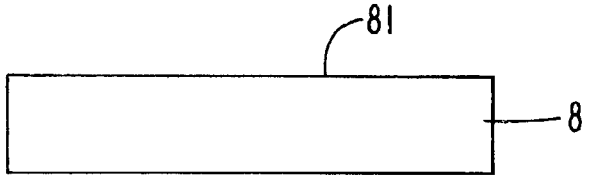
FIG. 7 is a view showing the printing method of this invention.
Figure 7B:
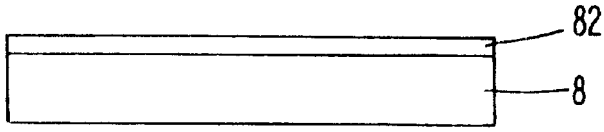
Figure 7C:
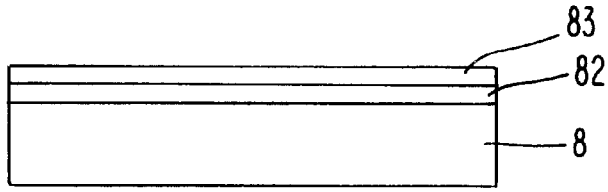
Figure 7D:
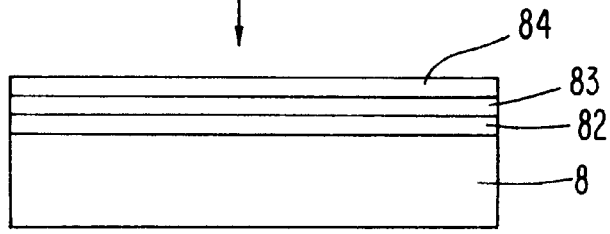
Figure 7E:
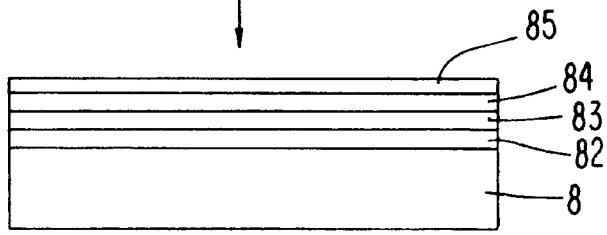

FIGS. 5 and 6 are a perspective and a side elevation that indicate outlined construction of a tray transporting unit 6. By referring to these Figs., it will be seen that the tray transporting unit 6 has a pair of sprockets 61 and 62 that can engage in the sprocket holes 72 and 73 on both sides of a medium transporting unit 7 and an interval adjustment mechanism 10 that moves these sprockets 61 and 62 to a position closer to or away from the nozzle surface 33 (see FIG. 2) of an ink jet head 32 of a head unit 3 and a driving power transmitting mechanism 9 that rotates the pair of sprockets 61 and 62.

The sprocket 61 of this example is composed of a pair of gears 63 and 64, a belt with gears 65 that is placed over these gears, and protruding pins 66 created at a certain interval on the outer circumference of this belt with gears 65. The belt with gears 65 is hung toward the transporting direction of the medium transporting tray as it draws along an oval loop. The sprocket 62 also has the same structure and has a pair of gears 67 and 68 and a protruding pin 70 on the outer circumference of this belt with gears 69. A flat outer run on the top of these pairs of belts with gears 65 and 69 regulates the height of the transporting surface of the medium tray and, therefore, the position of a medium relative to the print head.

An interval adjustment mechanism 10 has a common rotating shaft 11 that is for the gears 63 and 67 of each sprocket 61 and 62 and a common rotating shaft 12 for other gears 64 and 68 of each sprocket 61 and 62. These rotating shafts 11 and 12 are supported to rotate freely by a supporting means 13. The supporting means 13 has a bottom plate 131 and side plates 132 and 133 that stand perpendicularly at both sides of this bottom plate 131. Rotating shafts 11 and 12 are placed horizontally and parallel to a perpendicular direction of the transporting direction between both side plates 132 and 133.

The center of the bottom plate 131 is supported by an elevating means 14. The elevating means 14 has side plates 143 and 144 with horizontal notches 141 and 142 into which the bottom plate 131 of support 13 can be inserted from the horizontal direction and a flat bottom board plate that connects bottom sides of these side plates 143 and 144.

Also, one rotating shaft 145 is placed on the top of the horizontal notches 141 and 142 between the side plates 143 and 144. Top supporting rollers 146 and 147 are placed on both sides of this rotating shaft 145 to rotate freely. Two rotating shafts 148 and 149 are placed horizontally on the bottom of the notches 141 and 142 between the side plates 143 and 144 and bottom supporting rollers 151, 152 and 153, 154 are placed on both sides of each rotating shaft 148 and 149 to rotate freely.

The bottom plate 131 of the supporting means that is inserted horizontally into the flat notches 141 and 142 on the side plates 143 and 144 is held by the top supporting rollers 146 and 147 and the bottom supporting rollers 151, 152 and 153, 154. Therefore, it can elevate the supporting board 13 to slide horizontally.

One of the side plates 143 of the elevating means 14 has a part 156 that is extended to the bottom. A perpendicular rack 16 is formed on this part. This rack 16 engages a pinion 17 and this pinion 17 is mounted to the output shaft 181 of an elevating stepping motor 18.

Therefore, when the stepping motor 18 is activated, the elevating means 14 is elevated or lowered, the supporting means 13 is also elevated or lowered and the sprockets 61 and 62 of the rotating shafts 11 and 12 on this supporting means 13 will also be elevated. As a result of the above described means, the distance between the transporting surface of the medium transporting tray that is regulated by these sprockets 61 and 62 and the ink jet head 32 of the head unit 3 will be increased or decreased. Equivalently, the head may be moved vertically toward and away from the transporting means.

A drive transmitting mechanism rotates the sprockets 61 and 62 and includes one side of the rotating shaft 11 of the sprockets 61 and 62, a drive gear 19 fixed on the same shaft. This drive gear 19 engages a driving gear 20 that is placed on the side of a raised frame 2. The driving gear 20 is connected to a motor (not indicated in the figure) through a decelerating gear row 21. Therefore, when the driving motor is activated, the rotating shaft 11 rotates through the driving gear 20 and the following gear 19 and the sprockets 61 and 62 also rotate as one unit to transport the medium transporting tray 7 on these sprockets 61 and 62.

Now, both sides of two rotating shafts 11 and 12 extend outward horizontally through the side plates 132 and 133 on both sides of the supporting means 13. A guide 22 that has arched slots 221 and 222 and a guide 23 that arched slots 231 and 232 are placed on the outside of the side plates 132 and 133. Both sides of the rotating shafts 11 and 12 extend through 221, 231, and 222, 232 of each guide 22 and 23.

As explained well in FIG. 6, the elevating gear 19 engages the driving gear 20 that is located in a fixed position. In order to always engage the gear 19 with the driving gear 20, the gear 19 needs to be elevated along a circle trace 19*a* that surrounds the center of the rotation 20*a* of the driving gear 20. In this example, the rotating shafts 11 and 12 slide along the arched slots 221, 231, and 222, 232 along this arc 20*b*.

Now, in order to elevate the rotating shafts 11 and 12 along the arched notches, they need to move horizontally as they move through arc 20*b*. In this example, as mentioned earlier, the rotating shafts 11 and 12 support the supporting means 13 to slide horizontally by the elevating means 14 with the top supporting rollers 146 and 147 and the bottom supporting rollers 151, 152, and 153, 154. Therefore, the gear 19 can be elevated while engaging with the driving gear 20.

Next, the ink jet printer 1 of this example elevates flat beds 4 and 5 along with the elevation of the sprockets 61 and 62. As a result, the transporting side that is regulated by the sprockets 61 and 62 and the transporting side of the medium transporting tray 7 by the flat beds 4 and 5 are placed on the same side.

By referring to FIG. 1 or 3, each flat bed 4 and 5 has tray guides 41, 42, and 51, 52 that guide the side of the medium transporting tray 7 on both sides. Also, the flat beds have multiple numbers of rollers 43 and 53 that regulate the transporting side of the medium transporting tray 7. The horizontal support frames 45 and 55 for the rotating shafts 44 and 54 that support rollers 43 and 53 to rotate freely are supported by perpendicular linear guides 46 and 56 to be elevated. The horizontal support frames 45 and 55 have brackets 47 and 57 that are extended to the bottom. The racks 48 and 58 are perpendicularly placed on these brackets 47 and 57. The pinions 50 and 60 that are placed on the output shaft of each bed elevating motor 49 and 59 engage each rack 48 and 58.

When the motors 49 and 59 are activated, the horizontal support frames 45 and 55 can be elevated. In this example, by activating the elevating motor 18 along with the driving of the motors 49 and 59 of the tray transporting unit 6, the tray transporting side that is always regulated by the sprockets 61 and 62 and the tray transporting side that is regulated by each flat bed 4 and 5 are placed at the same height.

As explained above, the ink jet printer 1 of this example can print on the recording medium 8 on the medium transporting tray by moving the medium transporting tray 7 back and forth through the font position of the print head. Since the medium transporting tray 7 is transported by the sprockets 61 and 62, this printer can easily transport heavier recording media than a friction type transporting mechanism using general paper sending rollers can transport, but general paper sending rollers may be adequate for some light weight media of different thickness.

Also, according to the thickness of the recording medium 8 to be put on the medium transporting tray 7, a gap between the recording medium 8 to be transported and the nozzle side 33 of the ink jet head 32 can and should be maintained at constant distance. Therefore, thick recording media of different thicknesses can be printed.

Furthermore, in this example, the printer has the flat beds 4 and 5 located in front and back of the transporting direction. These flat beds elevate along with the sprockets 61 and 62 as one unit. Therefore, these flat beds 4 and 5 can support the medium transporting tray 7 to transport a long medium transporting tray 7.

FIG. 7 explains the printing method that creates printed images with water soluble ink on the surfaces of water absorbent recording media such as wood boards, and the like by using ink jet printers. Referring to FIG. 7, first of all, prepare a water absorbent recording medium 8 as indicated in FIG. 7(*a*) and apply resin such as acetic acid vinyl emulsion, or the like, on this printing surface 81. This resin contains the same ingredients as commercially-sold adhesive as wood craft bond. It changes into a transparent resin layer when it is dried. The adhesive creates an image receiving layer 82 on the printing surface 81. Any emulsion adhesive besides acetic acid vinyl emulsion can be used.

After the image receiving layer 82 is dried, a desirable printed image 83 can be created with water soluble ink on the surface of this image receiving layer 82 by using an ink jet printer as indicated in FIG. 7(*c*).

After printing, a ultraviolet ray resistant layer 84 is created on the surface of the printed image 83 by applying UV cut ingredient such as xylene solution, and the like as indicated in FIG. 7(*d*). Furthermore, a protection layer 85 of resin paint is created on the surface of the ultraviolet ray resistant layer 84 as indicated in FIG. 7(*e*).

As explained above, the printing method of this example can achieve durable and weather resistant printing with water soluble ink on the surfaces such as wood, and the like. Therefore, outdoor billboards, and the like can be printed easily and economically.

Now, if an image receiving layer 82 is created by using emulsion adhesive with coloring components such as cosmetics, dyes, and golden powder, and the like, base color of the printing surface can be chosen freely. Also, by mixing golden powder and silver powder, a variety of designs can be achieved on the printing surfaces. Furthermore, if the image receiving layer is created by using emulsion adhesive with fragrance, the printed materials that can appeal to both vision and smell can be materialized.

On the contrary, in order to adequately print on water resistant surfaces, for example, metal surface, plastic surface, and glass surface, and the like, the said image receiving surface 82 can be created by using emulsion adhesive with water resistant water soluble paint.

In addition, or separately, an image receiving surface 82 can be created by using emulsion adhesive with surfactant.

Also in this case, if the image receiving layer 82 is created by using emulsion adhesive with coloring components such as cosmetics, dyes, and golden or silver powder, and the like, base color of the printing surface can be chosen freely. Also, by mixing golden powder and silver powder, a variety of designs can be achieved on the printing surfaces. Furthermore, if the image receiving layer is created by using emulsion adhesive with fragrance, the printed materials that can appeal to both vision and smell can be materialized.

Of course, general ink type printers other than the said ink jet printers can also be used for the printing method of this invention.

As explained above, the printing method using an ink jet printer of this invention creates the image receiving surface that is adequate for the printing with water soluble ink by applying emulsion adhesive on the surface of the water absorbent, recording media. Therefore, an ink jet printer can be used to create permanent and durable printed images with water soluble ink on the surfaces like wood boards, porous plastic boards, and the like, of different thicknesses.

Also, the printing method of this invention creates an image receiving surface that is adequate for the printing with water soluble ink by applying emulsion adhesive with water resistant water soluble paint or applying emulsion adhesive with surfactant on the surface of the water resistant recording media. Therefore, durable printed images with water soluble ink that will not be peeled off can be created on the surfaces like plastic, metal, and glass, and the like, of different thicknesses by using ink jet printers.

What is claimed is:

1. A printing method that prints on recording media by using a water based ink type wide format printer, comprising: the step of printing on an image receiving layer with water based ink on the printing surface of a recording medium to which an emulsion adhesive image receiving layer has been applied, including the step of adjusting the layer of said recording medium and the print head of said printer toward and away from one another to apply said ink uniformly to said receiving layer on said recording media having variable thickness ranging from printing paper up to a relatively thick stiff panels of different thicknesses, including the steps of:

placing the recording medium on a recording medium transport tray;

transporting the medium transport tray through a printing position of the print head;

adjusting the medium transport tray toward and away from the print head so that the spacing between the print head and the image forming layer is adjusted to be a correct printing distance;

the step of transporting being carried out by a tray transport unit having a pair of sprockets, a common rotational shaft for each of the sprockets, a driven gear coaxially attached to the common rotational shaft, and a drive gear meshed with the driven gear;

the step of adjusting being carried out by an interval adjustment mechanism having an arc-shaped guide slot through which the common rotational shaft is slideably penetrated, wherein the arc-shaped guide slot is formed so that the driven gear attached on the common rotational shaft is allowed to move around a center of the drive gear while maintaining a meshed condition with the drive gear.

2. The method of claim 1, said medium having a printing surface which is water resistant.

3. The method of claim 1, said medium having a printing surface which is porous.

4. The method of claim 1, further comprising a step of supporting said medium on horizontal supports, while feeding said medium horizontally past the print head of the printer.

5. The method of claim 1, further comprising a step of supporting said medium on horizontal supports, while feeding said medium horizontally past the print head of the printer, and adjusting the vertical space between the print head and medium to correctly space the medium and the print head for printing on said medium.

6. In the method of claim 1, further comprising a step of providing a feed means for supporting said medium in a horizontal position while feeding said medium past the print head of said printer while the medium and print head are positioned vertically in correct position for printing on said medium.

7. In the method of claim 6, further comprising a step of positively feeding said medium past said print head.

8. In the method of claim 1, further comprising a step of providing a horizontally disposed support for receiving said medium while said support is moved horizontally past the print head of said printer and while the medium and said print head are positioned vertically in correct position for printing on said medium.

9. The method of claim 8, further comprising a step of providing means for positively moving said support past said print head.

10. An apparatus for wide format printing on stiff thick panels of different thickness to which an image forming layer has been applied, comprising:

a wide format printing machine having a print head, a medium transport tray on which a stiff thick panel to be printed is placed;

a tray transport unit adapted to transport the medium transport tray through a printing position of the print head;

an interval adjustment mechanism adapted to adjust the medium transport tray toward and away from the print head so that the spacing between the print head and the image forming layer is adjusted to be a correct printing distance;

the tray transport unit having a pair of sprockets, a common rotational shaft for each of the sprockets, a driven gear coaxially attached to the common rotational shaft, and a drive gear meshed with the driven gear;

the interval adjustment mechanism having an arc-shaped guide slot through which the common rotational shaft is slideably penetrated, wherein the arc-shaped guide slot is formed so that the driven gear attached on the common rotational shaft is allowed to move around a center of the drive gear while maintaining a meshed condition with the drive gear.

11. An apparatus for wide format printing on stiff thick panels of different thickness to which an image forming layer has been applied, comprising:

a wide format printing machine having a print head, a medium transport tray on which a stiff thick panel to be printed is placed;

a tray transport means for transporting the medium transport tray through a printing position of the print head;

an interval adjustment means for adjusting the medium transport tray toward and away from the print head so that the spacing between the print head and the image forming layer is adjusted to be a correct printing distance;

the tray transport means having a pair of sprockets, a common rotational shaft for each of the sprockets, a driven gear coaxially attached to the common rotational shaft, and a drive gear meshed with the driven gear;

the interval adjustment means having an arc-shaped guide slot through which the common rotational shaft is slideably penetrated, wherein the arc-shaped guide slot is formed so that the driven gear attached on the common rotational shaft moves around a center of the drive gear while maintaining a meshed condition with the drive gear.

12. An apparatus for wide format printing on stiff thick panels of different thickness to which an image forming layer has been applied, comprising:

a wide format printing machine having a print head, a medium transport tray on which a stiff thick panel to be printed is placed;

a tray transport unit adapted to transport the medium transport tray through a printing position of the print head;

an interval adjustment mechanism adapted to adjust the medium transport tray toward and away from the print head so that the spacing between the print head and the image forming layer is adjusted to be a correct printing distance;

the tray transport unit having at least one sprocket, a rotational shaft for the at least one sprocket, the at least one sprocket adapted to translate the medium transport tray along a direction of movement, a driven gear coaxially attached to the rotational shaft, and a drive gear meshed with the driven gear;

the interval adjustment mechanism having an arc-shaped guide slot through which the rotational shaft is slideably penetrated, wherein the arc-shaped guide slot is formed so that the driven gear attached on the rotational shaft is allowed to move around a center of the drive gear while maintaining a meshed condition with the drive gear.

* * * * *